US006154234A

United States Patent [19]

Ma

[11] Patent Number: 6,154,234

[45] Date of Patent: Nov. 28, 2000

[54] MONOLITHIC INK JET NOZZLE FORMED FROM AN OXIDE AND NITRIDE COMPOSITION

[75] Inventor: Shawming Ma, Sunnyvale, Calif.

[73] Assignee: Hewlett-Packard Company, Palo Alto, Calif.

[21] Appl. No.: 09/005,319

[22] Filed: Jan. 9, 1998

[51] Int. Cl.[7] ..... B41J 2/135

[52] U.S. Cl. ..... 347/45; 347/47

[58] Field of Search ..... 347/45, 44, 47, 347/63, 64, 65

[56] References Cited

U.S. PATENT DOCUMENTS

| | | | |
|---|---|---|---|
| 4,623,906 | 11/1986 | Chandrashekhar et al. | 347/45 X |
| 4,678,680 | 7/1987 | Abowitz | 347/47 X |
| 5,016,024 | 5/1991 | Lam et al. | 347/47 X |
| 5,255,017 | 10/1993 | Lam | 347/47 |
| 5,312,517 | 5/1994 | Ouki | 347/47 X |
| 5,387,440 | 2/1995 | Takemoto et al. | 347/45 X |
| 5,426,458 | 6/1995 | Wenzel et al. | 347/45 |
| 5,493,320 | 2/1996 | Sandbach et al. | 347/47 |
| 5,649,359 | 7/1997 | Murakami et al. | 347/45 X |
| 5,790,151 | 8/1998 | Mills | 347/47 |
| 5,812,158 | 9/1998 | Murthy et al. | 347/47 X |
| 5,859,654 | 1/1999 | Radke et al. | 347/47 X |

*Primary Examiner*—Richard Moses
*Attorney, Agent, or Firm*—Brian R. Short

[57] ABSTRACT

An ink jet nozzle. The ink jet nozzle includes a substrate having an upper surface in which an ink energizing element is attached to the upper surface of the substrate. The ink jet nozzle further includes an oxide-nitride or oxide-carbide composite orifice layer. The oxide-nitride composite orifice layer includes a lower surface conformally connected to the upper surface of the substrate, and an exterior surface facing away from the substrate. The oxide-nitride composite orifice layer defines a firing chamber. The firing chamber opens through a nozzle aperture in the exterior surface, and extends downward with a negative slope through the oxide-nitride orifice layer to expose the ink energizing element.

10 Claims, 6 Drawing Sheets

MONOLITHIC INK JET NOZZLE FORMED FROM AN OXIDE AND NITRIDE COMPOSITION

FIELD OF INVENTION

This invention relates generally to an ink jet print nozzle. In particular, it relates to an ink jet print nozzle in which inner walls of the ink jet print nozzle are formed from an oxide-nitride or oxide-carbide composition.

BACKGROUND

Ink jet printing mechanisms use pens that shoot droplets of ink onto a printable surface to generate an image. Ink jet printing mechanisms may be used in a wide variety of applications, including computer printers, plotters, copiers, and facsimile machines. For convenience, the concepts of the invention are discussed in the context of a printer.

An ink jet printer typically includes a print head having a multitude of independently addressable firing units. Each firing unit includes an ink chamber connected to a common ink source, and to an ink jet print nozzle. A transducer within each ink chamber provides the impetus for expelling ink droplets through the associated ink jet print nozzle. Typically, the transducer is a firing resistor which heats the ink until the ink droplets are expelled through the ink jet print nozzle.

Generally, a substrate supports the firing resistors. An orifice layer which includes the ink jet nozzles is attached to the substrate so that each ink jet nozzle corresponds with an associated firing resistor and forms an ink chamber.

To obtain a high resolution printed output, it is desirable to maximize the density of the firing units, requiring miniaturization of the print head components. The substrate that supports the firing resistors and the orifice layer that provides the ink jet nozzle above each resistor are subject to small dimensional variations that can accumulate and limit miniaturization.

Monolithic print heads have been developed through print head manufacturing processes which use photo imaging techniques similar to those used in semiconductor manufacturing. The components are constructed on a flat wafer by selectively adding and subtracting layers of various materials. Using photo-imaging techniques, dimensional variations are limited. Further variations do not accumulate because each layer is registered to an original reference on the wafer.

Existing monolithic print heads are complex to manufacture. Further, the ink jet nozzles are formed from either a polymer or metal material. Polymer and metal materials offer limited performance because the surfaces of these materials can be rough, and because these materials react corrosively with the ink. It is important that the surface of the ink jet nozzle be smooth so as to not interrupt the flow of ink through the ink jet nozzles. Further, corrosive reactions to the ink cause the ink jet nozzles to break down and deteriorate.

It is desirable to have an ink jet nozzle in which the surface of the ink jet nozzle is formed from a material which is smoother than presently existing materials. Further, the material would not react to ink which flows through the ink jet nozzle thereby increasing the useful life of the inkjet nozzle.

SUMMARY OF THE INVENTION

The present invention provides a monolithic ink jet nozzle which is formed from an oxide-nitride or oxide carbide composition. These compositions provide an ink jet nozzle which includes a smoother re-entrance surface than presently existing ink jet nozzles. Further, the compositions do not corrosively react to ink passing through the ink jet nozzle. Therefore, the ink jet nozzle is useful for a longer period of time than presently existing ink jet nozzles.

A first embodiment of the invention includes an ink jet nozzle. The ink jet nozzle includes a substrate having an upper surface in which an ink energizing element is attached to the upper surface of the substrate. The ink jet nozzle further includes an oxide-nitride or oxide-carbide composite orifice layer. The composite orifice layer includes a lower surface conformally connected to the upper surface of the substrate, and an exterior surface facing away from the substrate. The composite orifice layer defines a firing chamber. The firing chamber opens through a nozzle aperture in the exterior surface, and extends downward with a negative slope through the composite orifice layer to expose the ink energizing element.

Another embodiment of the invention includes a method of forming an ink jet nozzle over an ink energizing element on an upper surface of a substrate. The method includes the following steps. First, a positive sloped sacrificial oxide bump is created on the surface. Next, a nitride or carbide composite layer and an oxide layer are deposited over the surface and the sacrificial bump. The oxide and composite layers are polished forming an orfice layer. An opening in the orifice layer is created over the sacrificial oxide bump. Finally, the sacrificial oxide bump is removed yielding an ink jet nozzle.

Other aspects and advantages of the present invention will become apparent from the following detailed description, taken in conjunction with the accompanying drawings, illustrating by way of example the principles of the invention.

DETAILED DESCRIPTION

Figure 1:
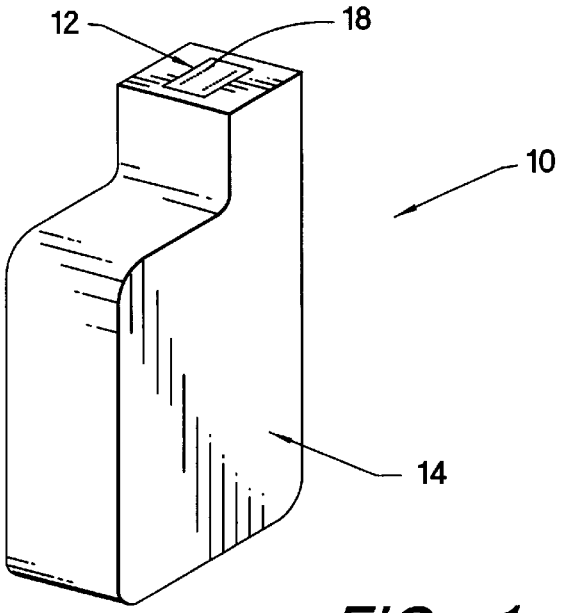
FIG. 1 is a perspective view of an ink jet pen having a print head which includes ink jet nozzles according to the invention.

As shown in the drawings for purposes of illustration, the invention is embodied in a monolithic ink jet nozzle. The ink jet nozzle is formed from an oxide-nitride or oxide carbide composition. The composition provides an ink jet nozzle which is smoother than presently used polymer ink jet nozzles. Further, the composition does not react to ink passing through the ink jet nozzle. Therefore, the ink jet nozzle lasts longer than presently existing ink jet nozzles.

FIG. 1 is a perspective view of an ink jet pen 10 having a print head 12 which includes ink jet nozzles 18 according to the invention. The ink jet pen 10 also includes a lower portion 14 containing an ink reservoir that supplies ink to the print head 12.

Figure 2:
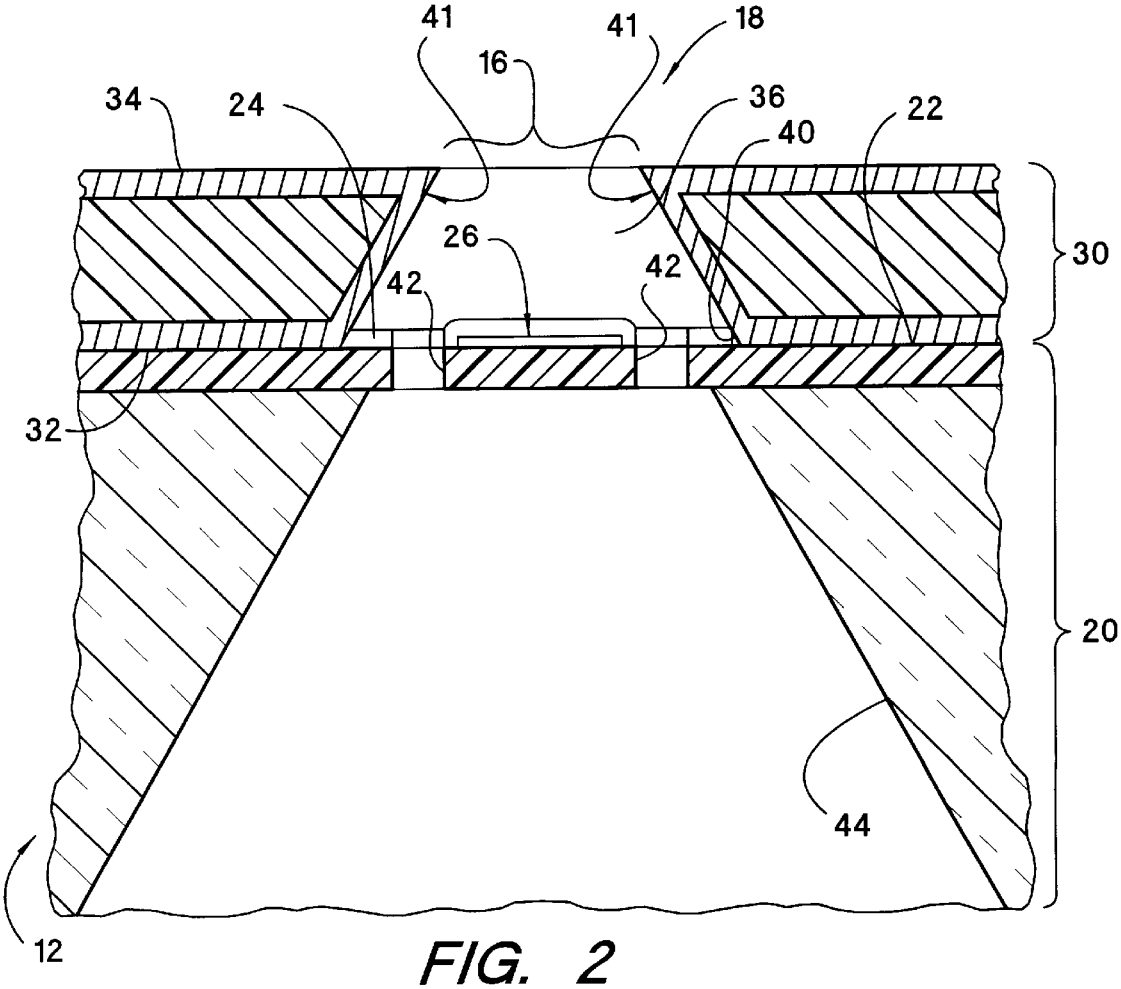
FIG. 2 is a cross-sectional view of an embodiment of the invention.

FIG. 2 is a cross-sectional view of an embodiment of the invention. This embodiment includes an ink jet nozzle 18.

The ink jet nozzle 18 is formed by a fructoconical firing chamber 36 of an orifice layer 30 attached to a silicon substrate 20. The substrate 20 includes a top surface 22 that is typically coated with a passivation layer 24. A thin film resistor 26 is typically formed over the top surface 22. The top surface 22 of the substrate forms a bottom section of the ink jet nozzle 18 which receives ink. The orifice layer 30 has a lower surface 32 that conformally rests above the top surface 22.

The ink jet nozzle 18 include walls 41 which are negatively sloped from a smaller circular external orifice 16 to a larger circular base periphery 40. The larger circular base periphery 40 is centered around the thin film resistor 26. The ink jet nozzle 18 is aligned on an axis of the thin film resistor 26.

The passivation layer 24 defines several ink supply vias 42 dedicated to the ink jet nozzle 18. The vias 42 are entirely encircled by the lower periphery 40 of the ink jet nozzle 18.

The walls 41 of the ink jet nozzle 18 are formed from a oxide-nitride or oxide-carbide material. The oxide-nitride or oxide-carbide material allows the walls 41 to be smoother than previously possible. Polymer walls, for example, are rougher. Rough walls impede the flow of ink flowing through the ink jet nozzle 18. The smooth walls 41 of the ink jet nozzle 18 of the invention do not impede the flow of ink passing through the fructoconical firing chamber 36 as much as rough polymer or rough metal walls.

The oxide-nitride or oxide-carbide walls 41 of the ink jet nozzle of the invention do not react to ink passing though the fructoconical firing chamber 36. Prior art ink jet nozzles are generally formed from materials which react to ink which makes physical contact with the surface of the nozzles. The reactions reduce the useable life time of the ink jet nozzle. That is, the material of the ink jet nozzle begins to break down, thereby reducing the performance of the ink jet nozzle.

The substrate 20 includes a tapered trench 44 which provides a path for ink to flow between the reservoir 14 and the ink jet nozzle 18.

Figure 3:
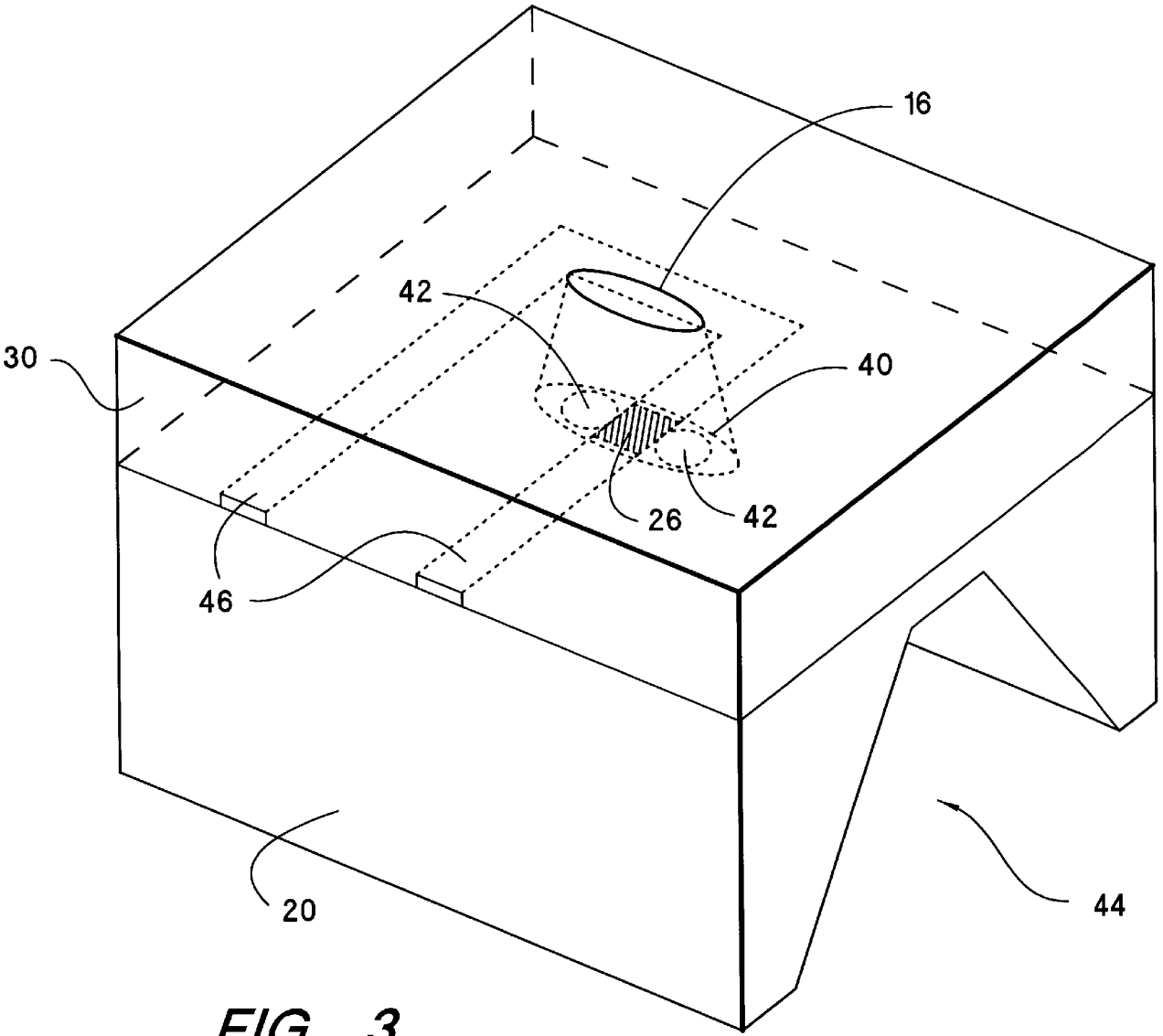
FIG. 3 is a perspective view of the embodiment of the invention shown in FIG. 2.

FIG. 3 is a perspective view of an embodiment of the invention. A conductor 46 provides a conductive path for current flowing through the thin film resistor 26. The thin film resistor 26 is a firing resistor which heats the ink until the ink droplets are expelled through the ink jet print nozzle 18.

Figure 4A:
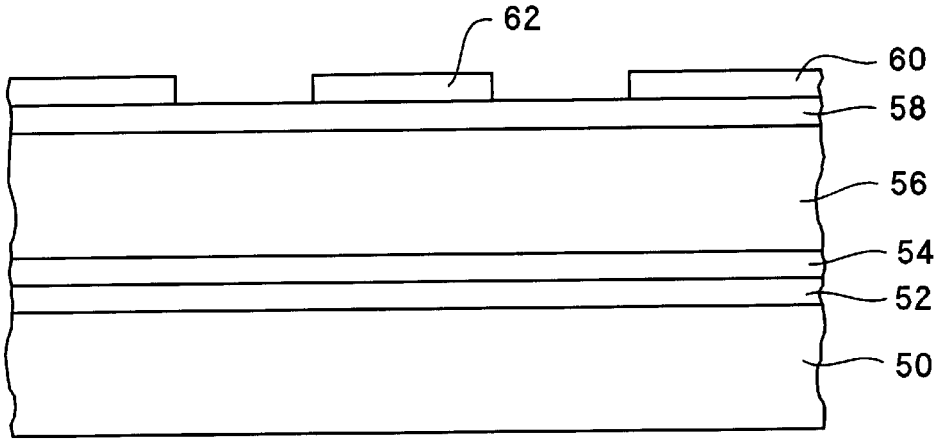
FIGS. 4A–4H show a series of steps in the formation of an embodiment of the invention.

FIGS. 4A–4H show a series of processing steps in the formation of an embodiment of the invention. First, a structure as shown in FIG. 4A is formed which includes a substrate 50, a first silicon-oxide ($SiO_2$) layer 52 and tantalum (Ta) layer 54. A second silicon-oxide layer 56 is deposited over the Ta layer 54. A poly-silicon layer 58 is deposited over the second-silicon oxide layer 56. Finally, a photo-resist layer 60 is deposited over the poly-silicon layer 58. The photo-resist layer 60 is patterned so that an island 62 of photo-resist is located where an ink jet nozzle is to be formed over the substrate 50. The photo-resist layer 60 pattern can be formed by a standard lithography process.

Figure 4B:
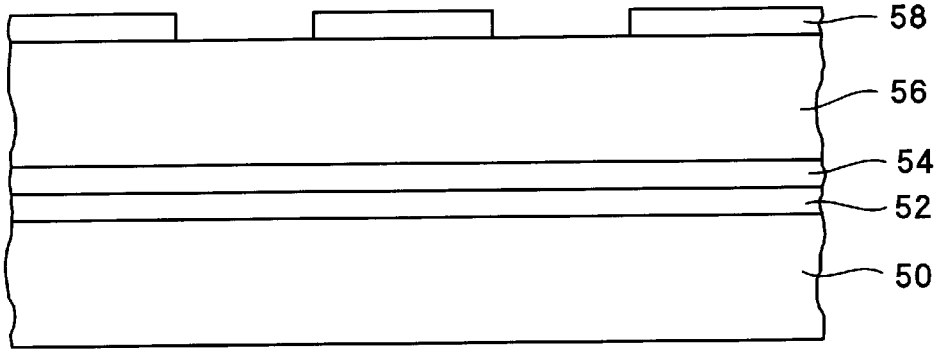

FIG. 4B shows the structure of FIG. 4A in which portions of the poly-silicon layer 58 and the photo-resist layer 60 have been removed through dry etching. Dry etching the poly-silicon layer 60 forms a pattern in the poly-silicon layer 58 as determined by the pattern originally formed in the photo-resist layer 60.

Figure 4C:
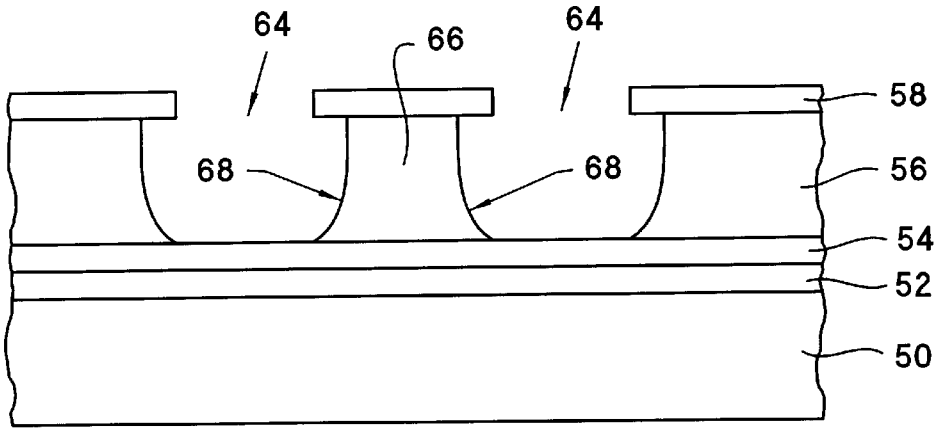

FIG. 4C shows the structure of FIG. 4B in which the second silicon-oxide layer 56 has been wet oxide isotopically etched. An aperture 64 is formed in the siliconoxide layer as determined by the pattern of the poly-silicon layer 58. The aperture 64 encircles a sacrificial bump 66. The sacrificial bump 66 is located where the ink jet nozzle is to be formed. The sacrificial bump 66 include positively sloped edges 68 which define the negatively sloped edges of the ink jet nozzle to be formed.

Figure 4D:
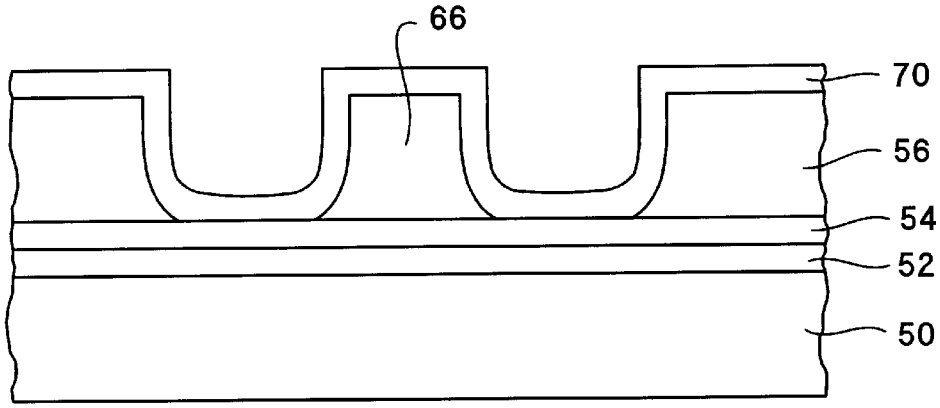

FIG. 4D shows the structure of FIG. 4C in which the poly-silicon layer 58 has been etched away, and a silicon-nitride ($Si_3N_4$) or silicon-carbide (SiC) layer 70 has been deposited over the second silicon-oxide layer 56.

Figure 4E:
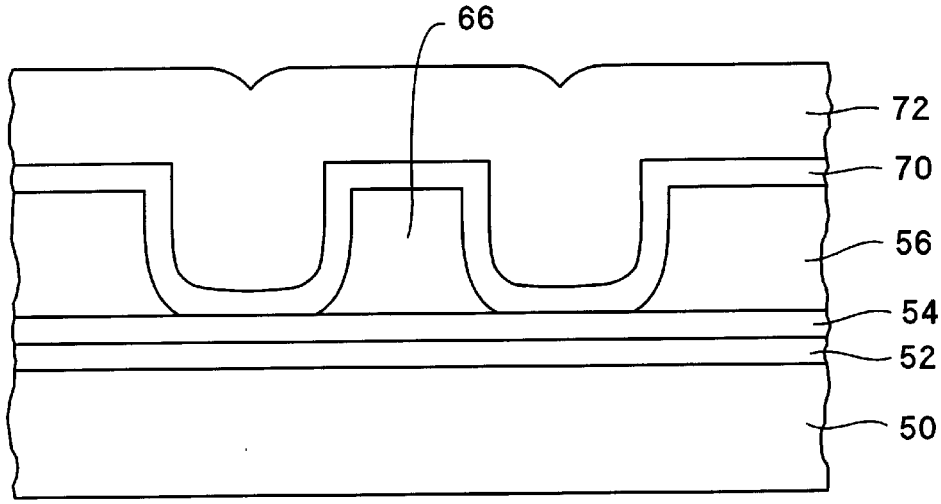

FIG. 4E shows the structure of FIG. 4D in which a third silicon-oxide layer 72 has been deposited over the silicon-nitride layer 70.

Figure 4F:
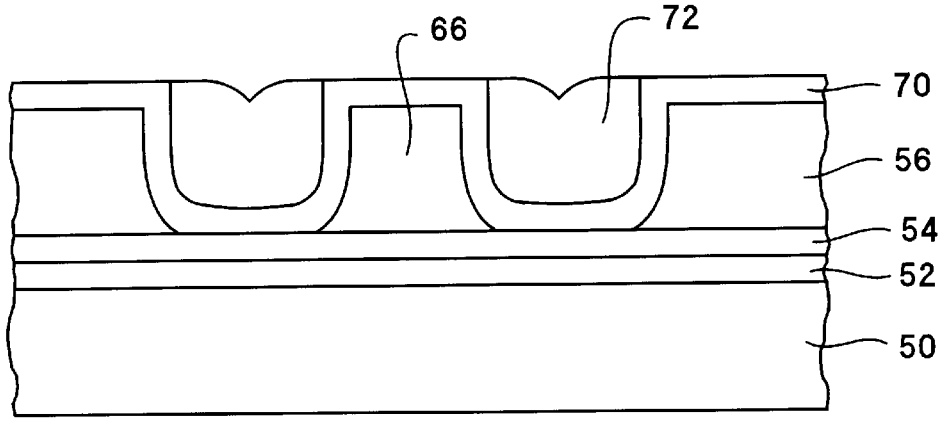

FIG. 4F shows the structure of FIG. 4E in which the third silicon-oxide layer 72 has been chemically-mechanically polished (CMP). The third silicon-oxide layer 72 is chemically-mechanically polished down to the silicon-nitride or silicon-carbide layer 70 forming an orifice layer 74. The orifice layer 74 includes the second silicon-oxide layer 56, the silicon-nitride or silicon-carbide layer 70, and portions of the third silicon-oxide layer 72.

Figure 4G:
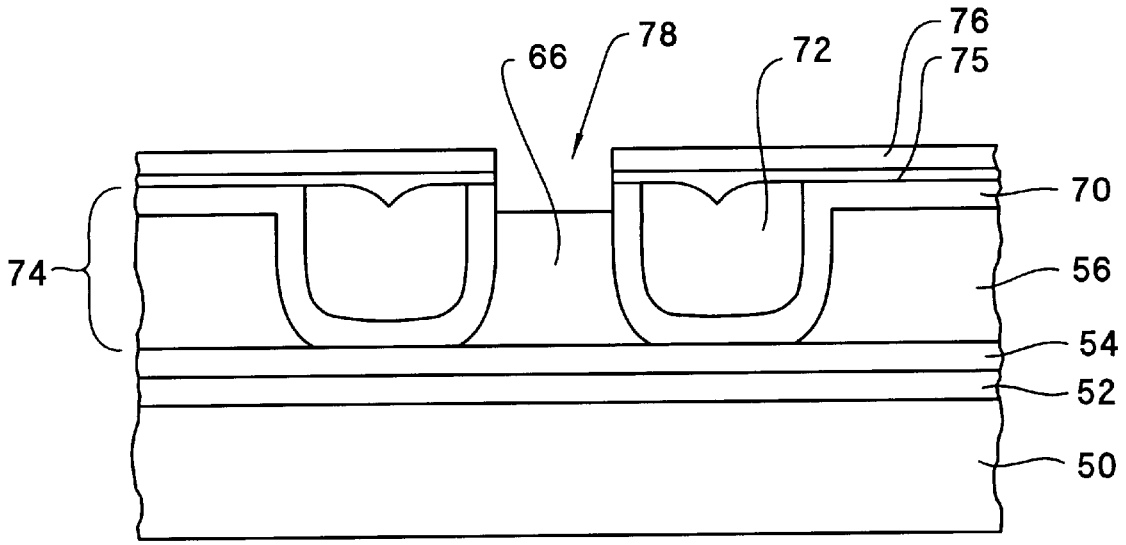

FIG. 4G shows the structure of FIG. 4F in which a protective layer 75 and second photo-resist layer 76 have been deposited over the orifice layer 74. The protective layer 75 and the second photo-resist 76 include an opening 78 aligned with the sacrificial bump 66. A portion of the silicon-nitride layer 70 which is aligned with the opening 78 is nitride dry etched down to the silicon-oxide layer 56 leaving the sacrificial bump 66 exposed. The protective layer is either a silicon-carbide and a silicon-nitride. Silicon-carbide may be the preferred protective layer 75 material because silicon-carbide provides a very hard surface.

Figure 4H:
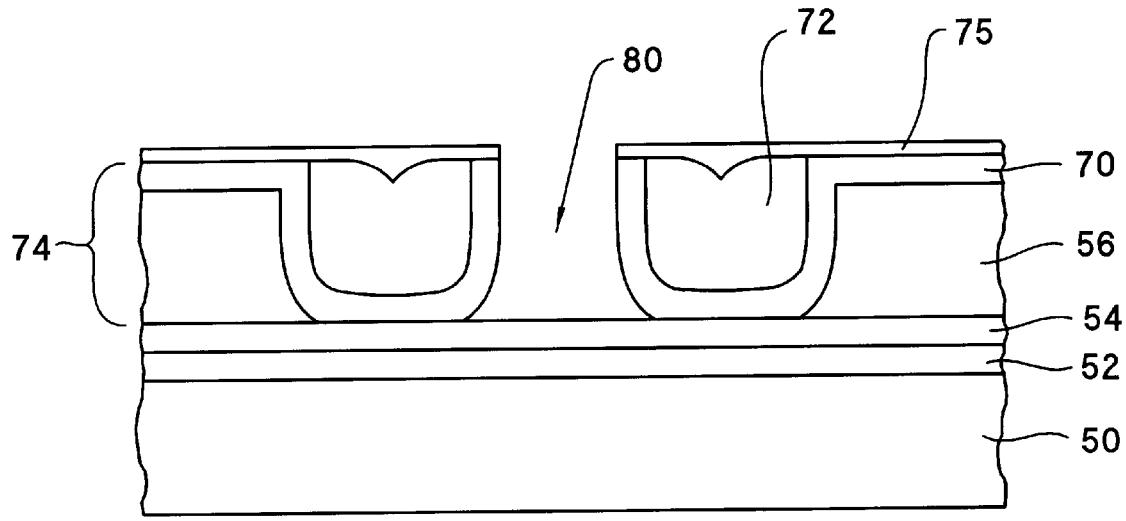

FIG. 4H shows the structure of FIG. 4G in which the exposed sacrificial bump 66 and the second photo-resist layer 76 have been removed through wet oxide etching. Removing the sacrificial bump 66 results in the formation of an ink jet nozzle 80 in the orifice layer 74.

Figure 5A:
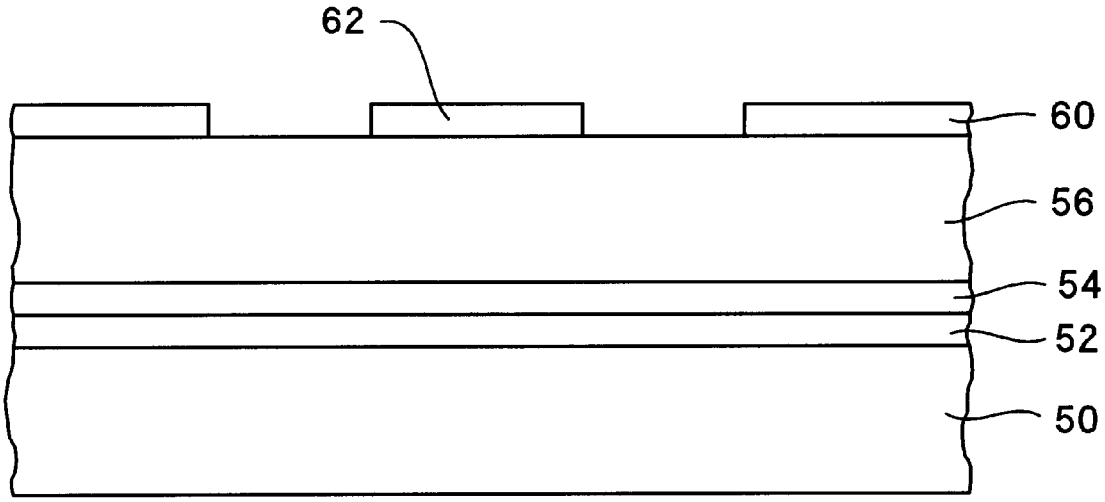
FIGS. 5A, 5B show alternative processing steps to the processing steps shown in FIGS. 4A–4C.
Figure 5B:
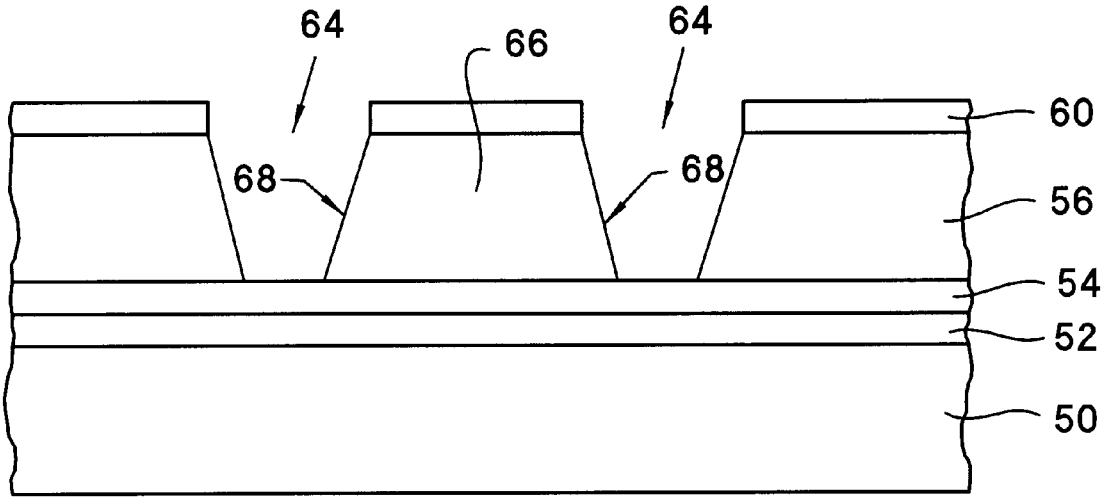

FIGS. 5A, 5B show alternative processing steps to the processing steps shown in FIGS. 4A, 4B, 4C. First, a structure as shown in FIG. 5A is formed which includes a substrate 50, a first silicon-oxide ($SiO_2$) layer 52 and tantalum (Ta) layer 54. A second silicon-oxide layer 56 is deposited over the Ta layer 54. Finally, a photo-resist layer 60 is deposited over the silicon-oxide layer 56. The photo-resist layer 60 is patterned so that an island 62 of photo-resist is located where an ink jet nozzle is to be formed over the substrate 50. The photo-resist layer 60 pattern can be formed by a standard lithography process.

FIG. 5B shows the structure of FIG. 5A in which the second silicon-oxide layer 56 has been dry etched. An aperture 64 is formed in the silicon-oxide layer as determined by the pattern of the photo-resist layer 60. The aperture 64 encircles a sacrificial bump 66. The sacrificial bump 66 is located where the ink jet nozzle is to be formed. The sacrificial bump 66 include positively sloped edges 68 which define the negatively sloped edges of the ink jet nozzle to be formed.

Subsequent processing steps to the structure shown in FIG. 5B are the same as those shown in FIGS. 4D–4H.

Although specific embodiments of the invention have been described and illustrated, the invention is not to be limited to the specific forms or arrangements of parts so described and illustrated. The invention is limited only by the claims.

What is claimed is:

1. A method of forming an ink jet nozzle over an ink energizing element on an upper surface of a substrate, the method comprising:

creating a positive sloped sacrificial oxide bump on the surface;

depositing an etch stop layer and an oxide layer over the surface and the sacrificial bump;

polishing the oxide to the etch stop layer forming an orifice layer;

creating an opening in the orifice layer over the sacrificial oxide bump; and removing the sacrificial oxide bump.

2. The method of forming an inkjet nozzle as recited in claim 1, wherein the step of creating a sacrificial bump comprises:

depositing a silicon-oxide layer over the upper surface of the substrate;

depositing a hard mask layer over the silicon-oxide layer;

removing a pattern of the hard mask layer so that an island of hard mask layer is located over the ink energizing element;

wet oxide isotropic etching the silicon-oxide forming apertures in the silicon-oxide where the hard mask layer has been removed; and etching the remaining hard mask layer and any residual resist.

3. The method of forming an ink jet nozzle as recited in claim 1, wherein the step of creating a sacrificial bump comprises:

depositing a hard mask layer over the silicon layer;

removing a pattern of the hard mask layer so that an island of hard mask layer is located over the ink energizing element;

dry etching the silicon-oxide forming apertures in the silicon-oxide where the hard mask layer has been removed; and etching the remaining hard mask layer and any residual resist.

4. The method of forming an ink jet nozzle as recited in claim 2, wherein the step of removing a pattern of the hard mask layer comprises:

depositing a resist layer over the hard mask layer so that an island of resist is located over the ink energizing element; and dry etching the hard mask layer so that the hard mask layer is removed where the resist layer does not exist.

5. The method of forming an ink jet nozzle as recited in claim 2, wherein the step of depositing a hard mask layer comprises depositing a poly-silicon layer.

6. The method of forming an ink jet nozzle as recited in claim 1, wherein the step of depositing an etch layer comprises depositing a nitride layer.

7. The method of forming an ink jet nozzle as recited in claim 1, wherein the step of depositing an etch layer comprises depositing a carbide layer.

8. The method of forming an ink jet nozzle as recited in claim 1, wherein the step of polishing the oxide to the etch stop layer comprises chemically-mechanically polishing the oxide layer to the etch stop layer.

9. The method of forming an ink jet nozzle as recited in claim 1, wherein the step of removing the sacrificial oxide bump comprises:

forming a hole in the orifice layer exposing the sacrificial oxide bump; and wet etching the sacrificial oxide bump forming the ink jet nozzle.

10. The method of forming an ink jet nozzle as recited in claim 9, wherein the step of forming a hole in the orifice layer comprises:

depositing a photo-resist pattern over the orifice layer; and dry etching the orifice layer forming a hole where the photo-resist does not exist.

* * * * *